US008342326B1

(12) United States Patent
Steffes

(10) Patent No.: US 8,342,326 B1
(45) Date of Patent: Jan. 1, 2013

(54) PLUNGER CADDY

(76) Inventor: Teresina Steffes, El Sobrante, CA (US)

( * ) Notice: Subject to any disclaimer, the term of this patent is extended or adjusted under 35 U.S.C. 154(b) by 0 days.

(21) Appl. No.: 13/469,322

(22) Filed: May 11, 2012

(51) Int. Cl.
*A47G 29/08* (2006.01)

(52) U.S. Cl. ..... 206/349

(58) Field of Classification Search ..... 206/233, 206/349, 361, 389, 391, 15.2, 15.3
See application file for complete search history.

(56) References Cited

U.S. PATENT DOCUMENTS 5,924,566 A 7/1999 Gibbs
D422,821 S 4/2000 Laur
6,193,059 B1 * 2/2001 Massaro ..... 206/225
D498,626 S 11/2004 Thomas
D621,190 S 8/2010 Yoo et al.
7,861,858 B2 * 1/2011 Wang ..... 206/349
2002/0100705 A1 * 8/2002 Phillips et al. ..... 206/349
2008/0135432 A1 * 6/2008 Cortinas ..... 206/349
2008/0197030 A1 * 8/2008 Wang ..... 206/216
2008/0308438 A1 * 12/2008 Giles ..... 206/349

* cited by examiner

*Primary Examiner* — Jacob K Ackun

(57) ABSTRACT

A plunger caddy providing for discreet storage, sanitary handling and transport of and ease of access to a toilet plunger. A feature of the invention is that the bulb portion of the plunger never has to pass by or go near where the handle of the plunger is stored. With either three sides (with no door on the back side) or four sides (with a door on the back side) enclosing the plunger, the plunger caddy can be positioned so that the plunger is out of view.

1 Claim, 7 Drawing Sheets

PLUNGER CADDY

BACKGROUND

Field of Invention

This invention relates to a plunger caddy for storing of a toilet plunger.

Caddies, or holders, for toilet or drain plungers typically are designed to accommodate only certain size or type plungers. Further, plunger caddies typically are designed so that the plunger handle and/or part of the plunger bulb are visible in storage, not hidden from view. In addition, a caddy should have a way to allow water to drain from the plunger and evaporate so as to prevent the formation of mold or mildew or unpleasant odors. It would be beneficial to have a plunger caddy that would hold any type or size plunger, would have a feature to allow water drainage from the plunger, would allow the plunger to be completely hidden from view for aesthetic value, be easily storable in a bathroom, and would have a feature to allow it to be easily and sanitarily carried from room to room.

SUMMARY OF THE INVENTION

This invention relates to a plunger caddy that provides discreet storage, easy and sanitary access, ease of transport to other rooms, and water drainage and ventilation to avoid mildew and odor. The plunger caddy can accommodate many plunger sizes and designs. The bulb portion of the plunger never passes by the handle portion of the plunger caddy, allowing for sanitary handling of the plunger caddy and the plunger inside.

The invention provides:

10. hiding of the plunger from view when the open side (back side) is placed against a wall or complete enclosure of the plunger when produced with a door on the open side (back side)
11. sanitary enclosure of the plunger
12. sanitary access to the plunger
13. ease of access to the plunger
14. ease of transportation of the plunger to other rooms
15. a grid for drainage of water from the plunger
16. ventilation to avoid mildew and odor (by open back or ventilation slots on the door)
17. an aesthetic way to store the plunger
18. accommodation of many plunger sizes and designs The invention allows one to keep the plunger handy for use when needed in the bathroom but still to be able to keep it from view in a utilitarian and attractive storage container to allow it to be easily and sanitarily carried from room to room.

The invention has a front wall and two side walls. It can also have a back wall that serves as a door. Each wall narrows towards the top to form a handle. The handle allows for easy transport from one bathroom to another. The design may have an open back or a closed back (door) to provide ease of storage and removal when needed. The open side has a closure strap on the handle to secure the plunger in the caddy. The door also has a closure strap to secure the door. The open back or the ventilation holes on the door both provide ventilation for drying of the plunger and prevention of mold and mildew growth. The grid pattern at the bottom is to provide an area for water to drain onto from the plunger and then evaporate. In either the open back design or the design with the door the plunger and its handle will be hidden from view.

Figure 1:
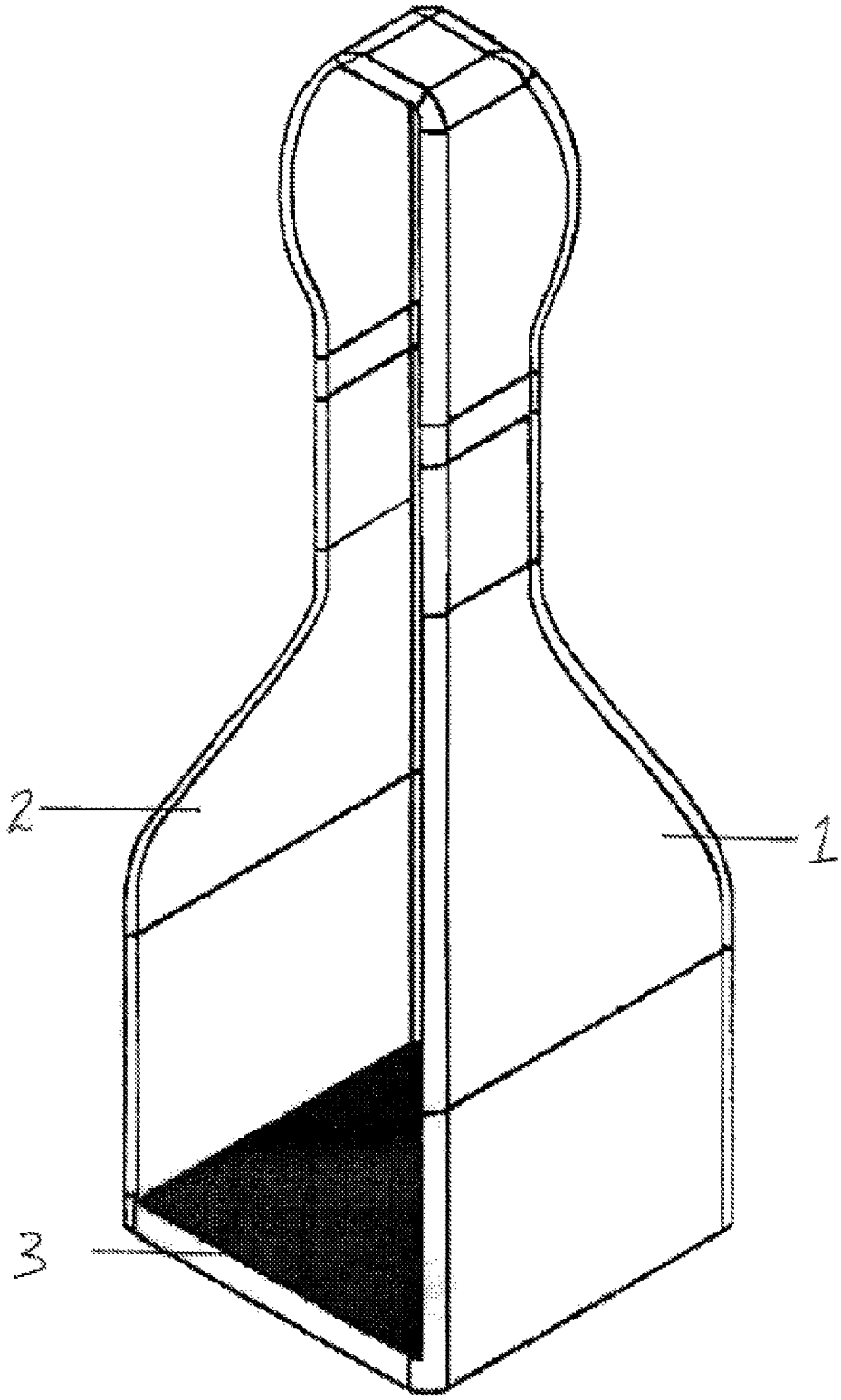
FIG. 1 shows a perspective drawing of the left side view of the plunger caddy with an open back side and inside grid made in accordance with the present invention.

Following is a summary legend of the reference numbers used in the drawings:

1 Left side of plunger caddy
2 Right side of plunger caddy
3 Inside grid
4 Closure strap on handle
5 Inside view of door
6 Closure strap on door
7 Holder for closure strap on door
8 Outside view of door
9 Set of three ventilation holes
10 Handle
11 Attachment of door to plunger caddy body

DESCRIPTION OF THE PREFERRED EMBODIMENT

The invention provides for discreet storage, sanitary handling and transport of and ease of access to the plunger. A feature of the invention is that the bulb portion of the plunger never has to pass by or go near where the handle of the plunger is stored. With either three sides (with no door on the back side) or four sides (with a door on the back side) enclosing the plunger, the plunger caddy can be positioned so that the plunger is out of view.

The invention is a four-sided unit.

In one configuration of the invention three sides are enclosed and the backside is open.

In a second configuration of the invention the open side of the handle has a closure strap to secure the plunger inside the caddy.

In a third configuration of the invention the open side is enclosed as described above with a door and strap closure.

The inside bottom of the enclosure is where the bulb part of the plunger resides. The top of the enclosure forms the handle of the caddy and is where the plunger handle resides, providing easy and sanitary transport. The inside bottom floor has a grid design to allow for water drainage. Both the open back design and the design with the vented door allow for ventilation to dry any water drainage from the plunger, preventing the formation of mold and mildew. Placing vents or any other open and aesthetically-pleasing ventilation design on any of the sides can provide additional ventilation.

FIG. 1 is a perspective drawing of the left side 1 view of the plunger caddy with an open back side and inside grid 3 drawn in accordance with the present invention. The inside view of the right side 2 is shown through the back side.

Figure 2:
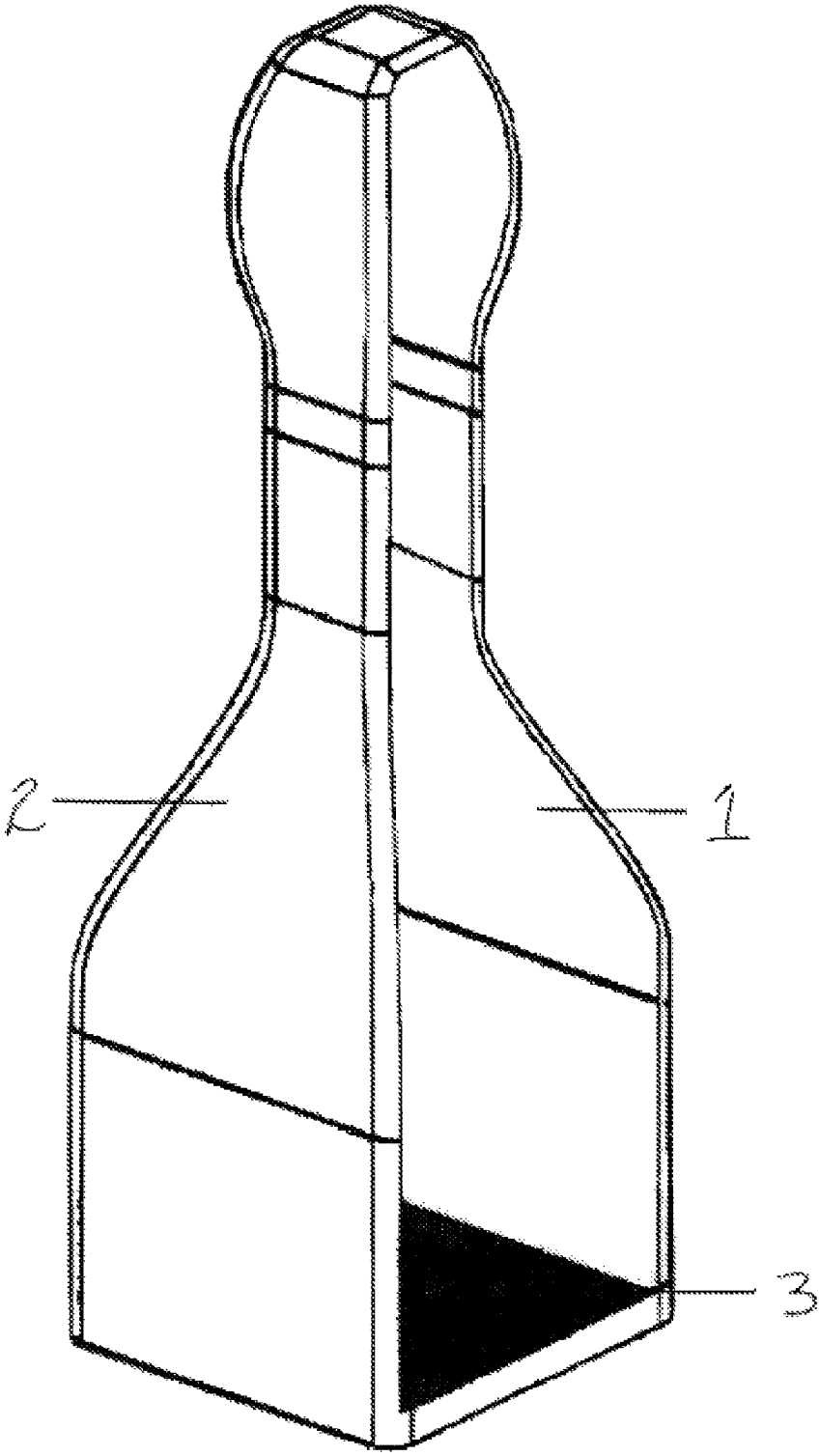
FIG. 2 shows a perspective drawing of the right side view of the plunger caddy with an open back side and inside grid made in accordance with the present invention.

FIG. 2 is a perspective drawing of the right side 2 view of the plunger caddy with an open back side and inside grid 3 drawn in accordance with the present invention. The inside view of the left side 1 is shown through the back side.

Figure 3:
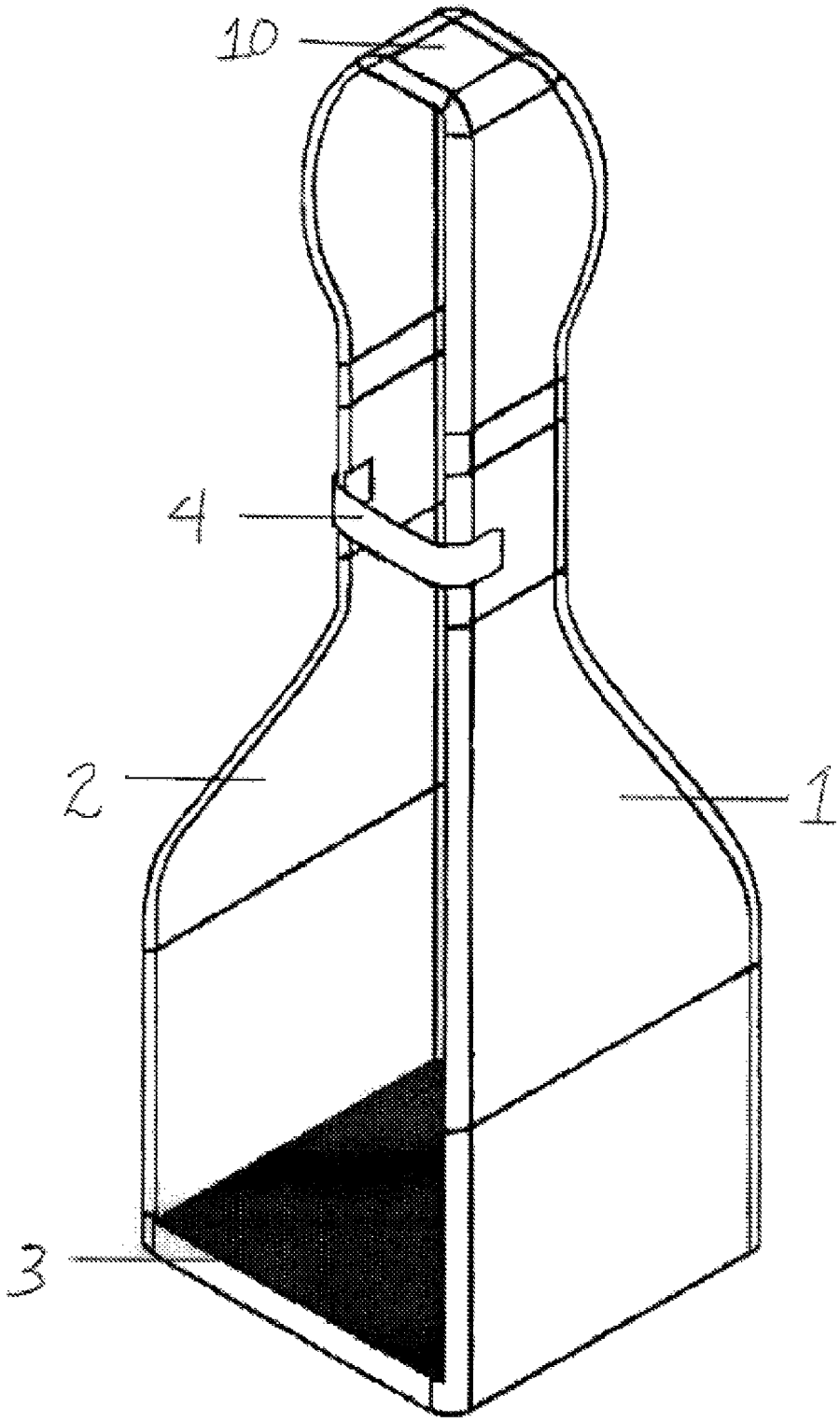
FIG. 3 shows a perspective drawing of the left side view of the plunger caddy with an open back side and inside grid and closure strap made in accordance with the present invention.

FIG. 3 is a perspective drawing of the left side 1 view of the plunger caddy with an open back side and closure strap 4 on the handle 10 and inside grid 3 drawn in accordance with the present invention. The inside view of the right side 2 is shown through the back side.

Figure 4:
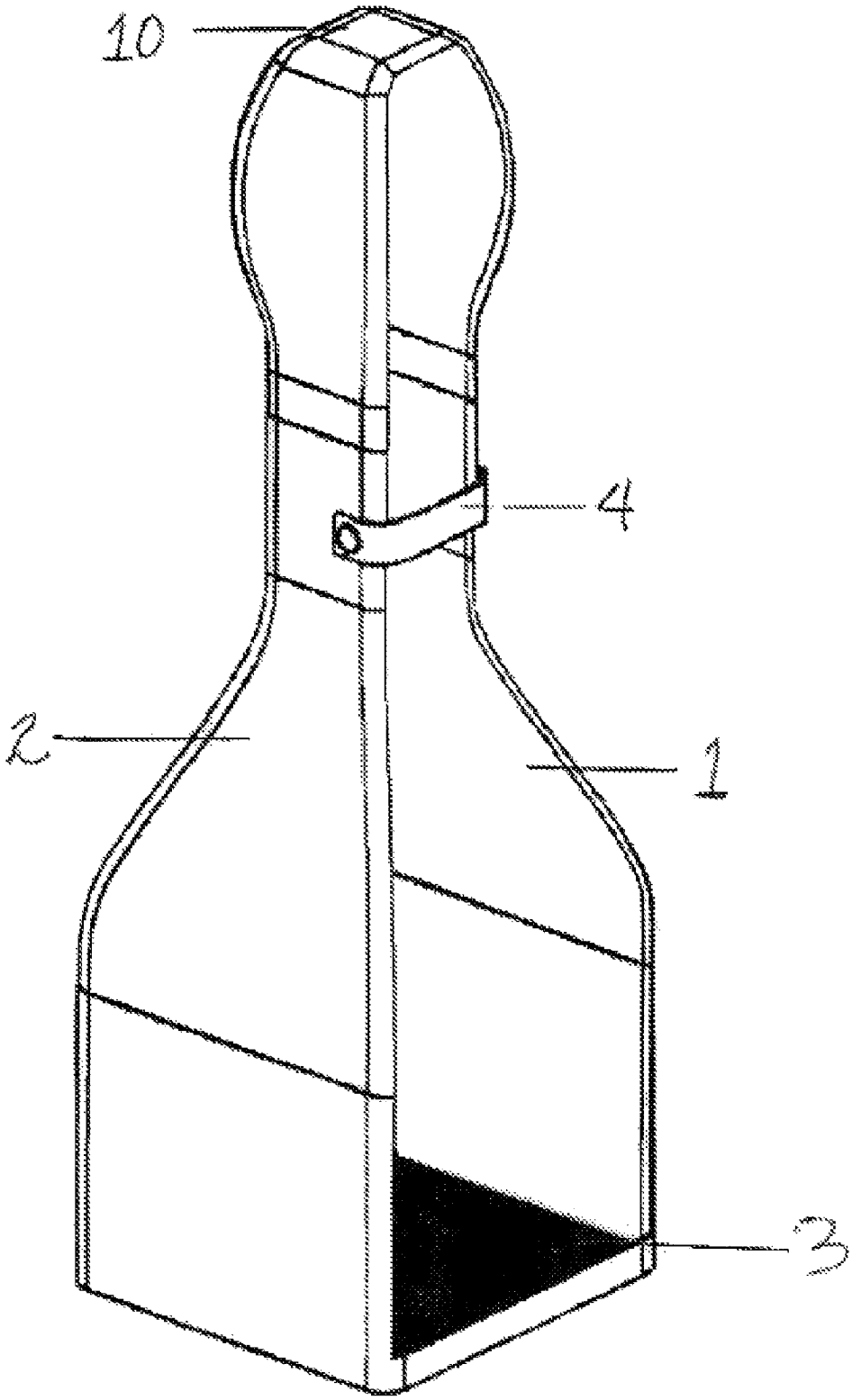
FIG. 4 shows a perspective drawing of the right side view of the plunger caddy with an open back side and inside grid and closure strap made in accordance with the present invention.

FIG. 4 is a perspective drawing of the right side 2 view of the plunger caddy with an open back side and closure strap 4 on the handle 10 and inside grid 3 drawn in accordance with the present invention. The inside view of the left side 1 is shown through the back side.

Figure 5:
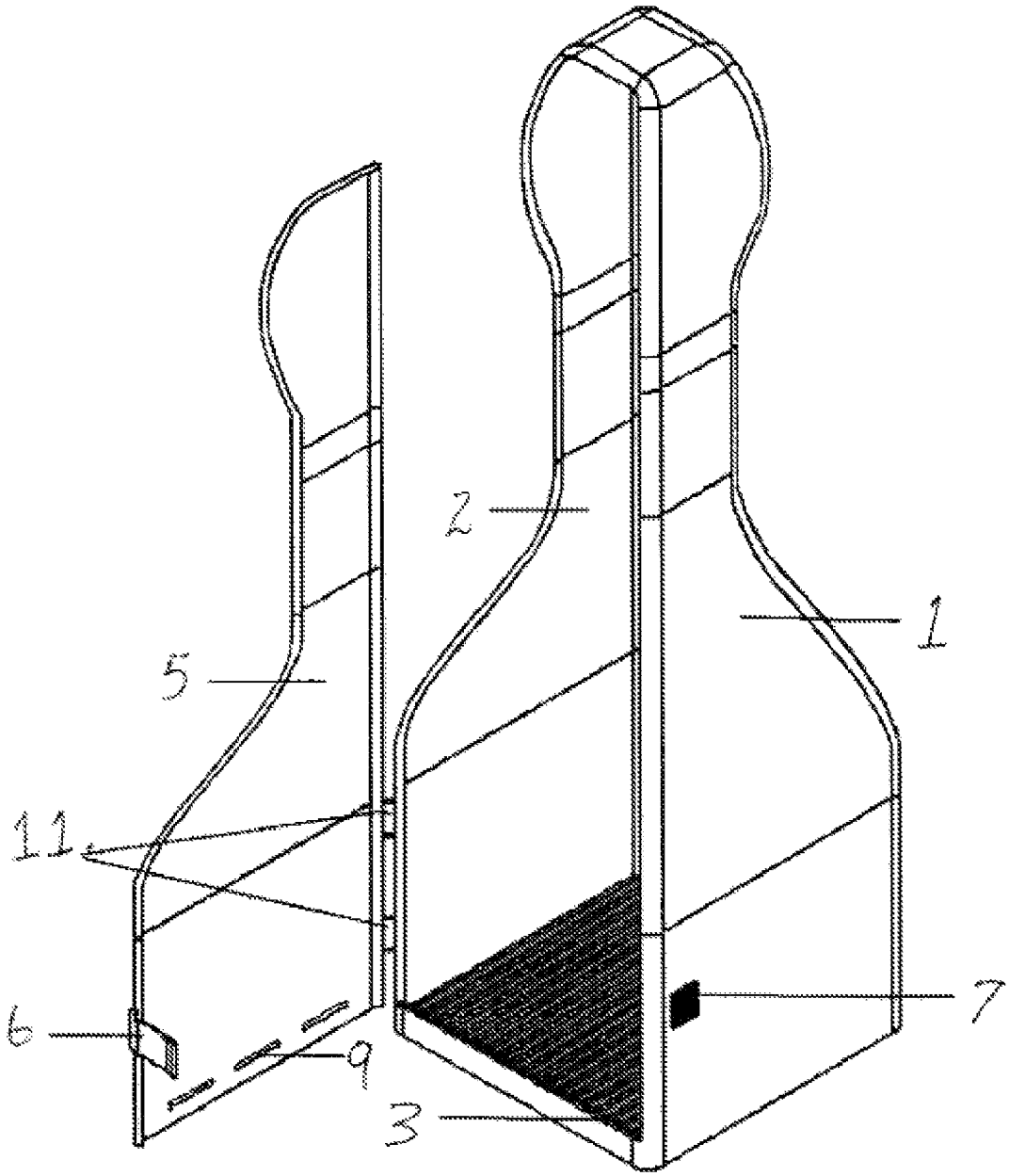
FIG. 5 shows a perspective drawing of the left side view of the plunger caddy with a back side door with ventilation holes in the open position and inside grid made in accordance with the present invention.

FIG. 5 is a perspective drawing of the left side 1 view of the plunger caddy with a back side door 5 in the open position and inside grid 3 drawn in accordance with the present invention. The inside view of the right side 2 is shown through the back side. The inside view of the door 5 is shown. Attachment to door 11 is shown. A closure strap 6 on the door is shown. A holder 7 for the closure strap 6 is shown on the left side of the caddy. A set of three ventilation holes 9 is shown at the bottom of the door.

Figure 6:
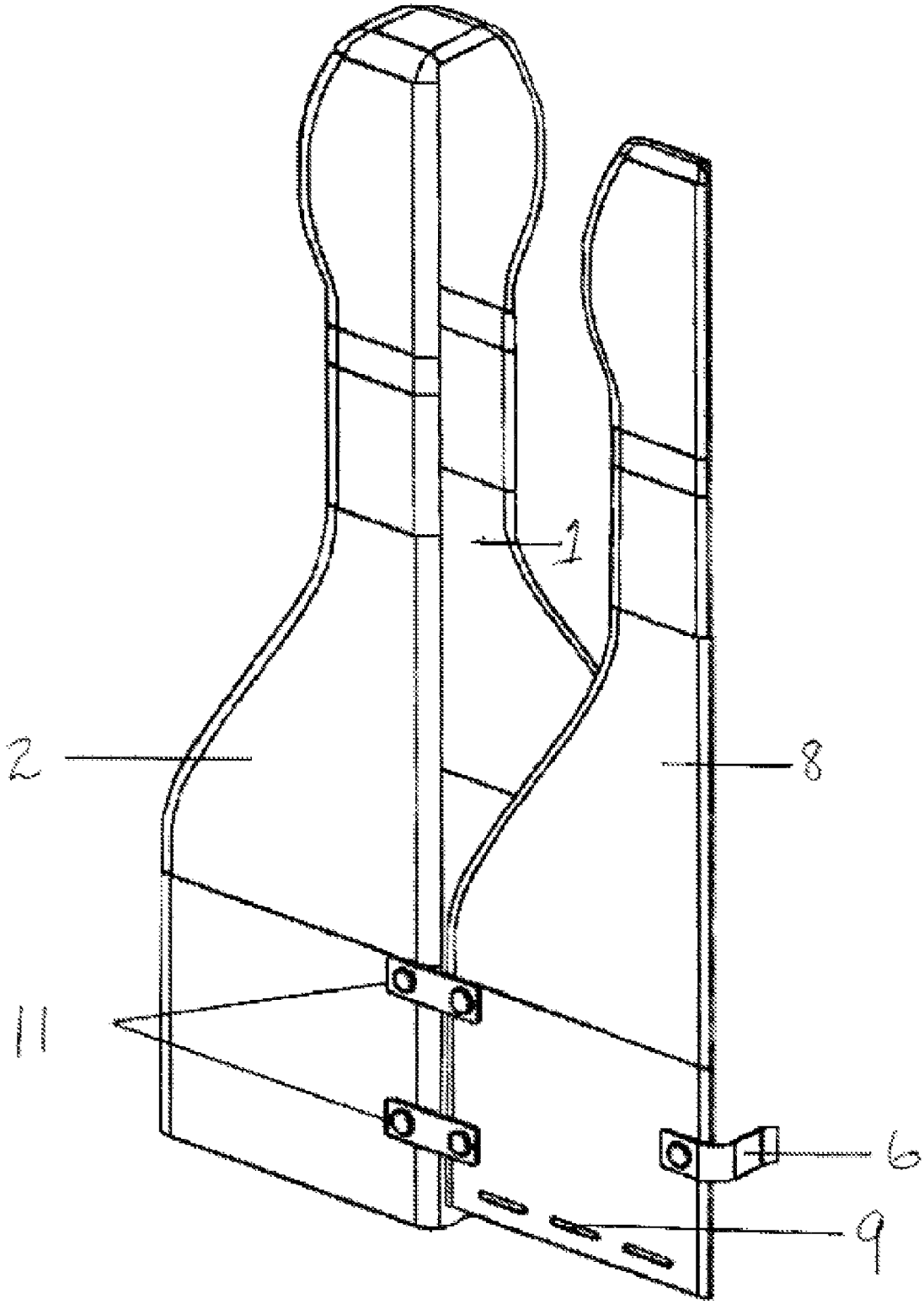
FIG. 6 shows a perspective drawing of the right side view of the plunger caddy with a back side door with ventilation holes in the open position and closure strap made in accordance with the present invention.

FIG. 6 is a perspective drawing of the right side 2 view the plunger caddy with a back side door in the open position drawn in accordance with the present invention. The inside view of the left side 1 is shown through the back side. The outside view of the door 8 is shown. Attachment to door 11 is shown. A closure strap 6 on the door is shown. A set of three ventilation holes 9 is shown at the bottom of the door.

Figure 7:
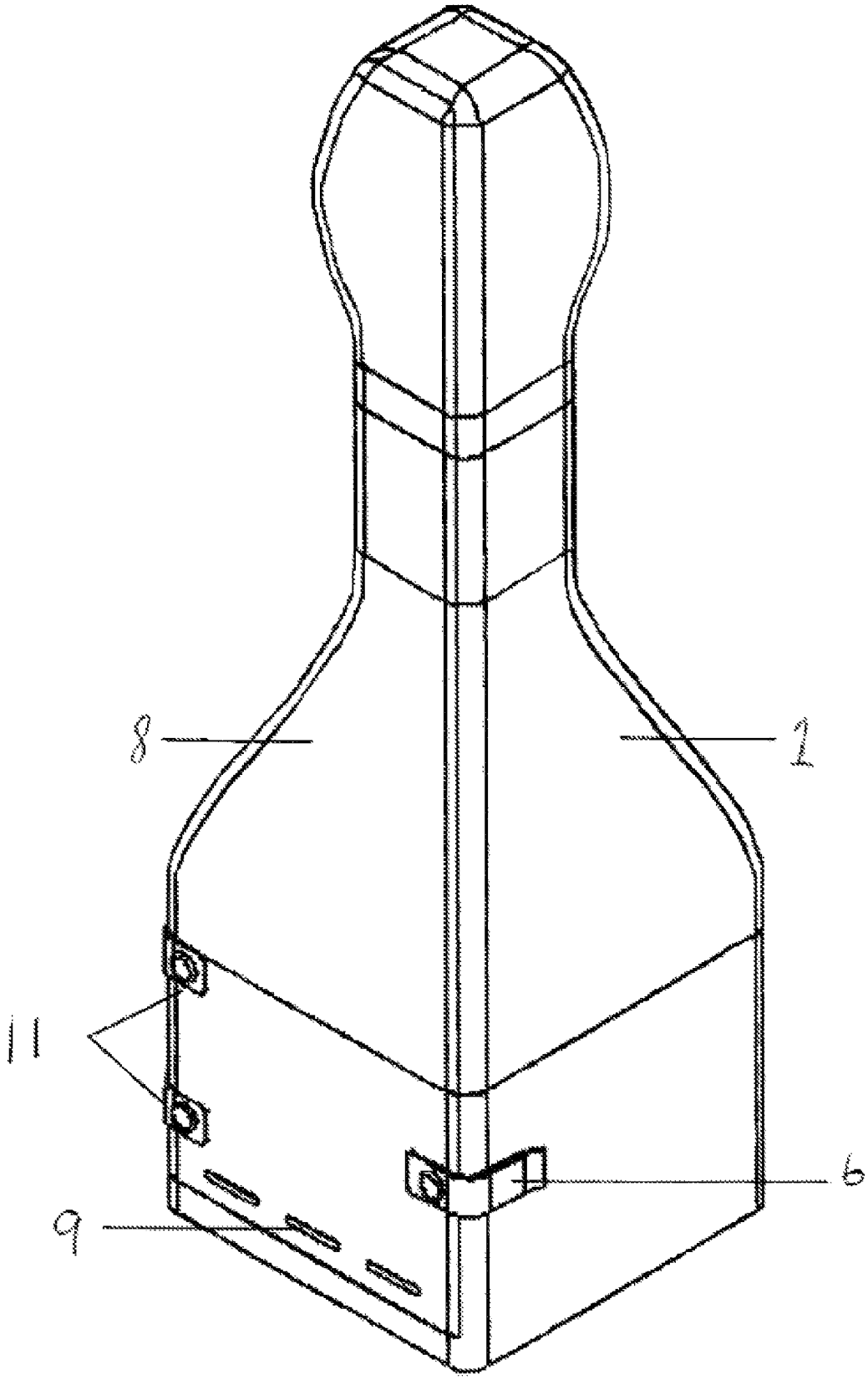
FIG. 7 shows a perspective drawing of the left side view of the plunger caddy with a back side door with ventilation holes in the closed position and a closure strap made in accordance with the present invention.

FIG. 7 is a perspective drawing of the left side 1 view of the plunger caddy with a back side door 8 in the closed position drawn in accordance with the present invention. Attachment to door 11 is shown on the door. A closure strap 6 is shown. A set of three ventilation holes 9 is shown at the bottom of the door.

It is preferred that the invention be made of plastic. It is preferred that the closure strap on the open back side configuration be located on the handle portion of the invention and attach to the opposite side of the caddy using Velcro. It is preferred that the closure strap on the back side door configuration be located on the bottom or bulb portion of the door and attach to the exterior surface of the caddy using Velcro. It is preferred that the door be attached or hinged to the bottom or bulb portion of the caddy. It is preferred that the exterior and interior surfaces of the invention be made of a color that compliments the décor of the room.

While the embodiments of the invention disclosed herein are considered to be preferred embodiments, changes or modifications such as to location of the closure strap, color, method of attachment of the door, or material used for manufacture can be made without departing from the spirit and scope of the invention. The focus of the invention is indicated in the claims incorporated herein and all changes that come within the range of equivalents to the claims are intended to be included herein.

What is claimed:

1. A plunger caddy for storing and transporting a toilet plunger, the caddy having a handle portion at a top thereof and a plunger bulb portion below the handle portion, the caddy further comprising three solid sides; a fourth open back side with a door on the back side attached at the bottom or bulb portion of the caddy with a closure strap attached to the door and secured to a side wall of the caddy to secure the door in the closed position; a grid on the inside bottom floor for water to drip from the plunger; and ventilation openings on the door.

* * * * *